US011951371B2

(12) United States Patent
Choe

(10) Patent No.: US 11,951,371 B2
(45) Date of Patent: Apr. 9, 2024

(54) GOLF SWING GUIDE APPARATUS

(71) Applicant: Jang Min Choe, Seoul (KR)

(72) Inventor: Jang Min Choe, Seoul (KR)

( * ) Notice: Subject to any disclaimer, the term of this patent is extended or adjusted under 35 U.S.C. 154(b) by 0 days.

(21) Appl. No.: 17/893,307

(22) Filed: Aug. 23, 2022

(65) Prior Publication Data

US 2024/0042298 A1 Feb. 8, 2024

(30) Foreign Application Priority Data

Aug. 4, 2022 (KR) ..... 10-2022-0097268

(51) Int. Cl.
*A63B 69/36* (2006.01)
*A63B 102/32* (2015.01)

(52) U.S. Cl.
CPC .... *A63B 69/36211* (2020.08); *A63B 69/3632* (2013.01); *A63B 2102/32* (2015.10); *A63B 2225/09* (2013.01)

(58) Field of Classification Search
CPC ..... A63B 69/36211; A63B 69/3632; A63B 2102/32; A63B 2225/09
USPC ..... 473/219, 223, 226, 228, 231–234, 238
See application file for complete search history.

(56) References Cited

U.S. PATENT DOCUMENTS 2,898,109 A * 8/1959 Williams ..... A63B 69/3685 356/255
4,576,378 A * 3/1986 Backus ..... A63B 21/00069 473/228
5,071,129 A * 12/1991 Wilson ..... A63B 69/3685 473/240
5,143,376 A * 9/1992 Johnson ..... A63B 69/3685 473/226
5,658,205 A * 8/1997 Bartscherer ..... A63B 69/3632 473/238
7,427,238 B1 * 9/2008 Oprandi ..... A63B 69/3632 473/223
7,780,542 B1 * 8/2010 Ross ..... A63B 69/3632 473/226
9,162,131 B1 * 10/2015 Watson ..... A63B 69/3632
9,174,109 B2 * 11/2015 Peterman ..... A63B 69/3632
10,532,264 B2 * 1/2020 Paster ..... A63B 53/007
2007/0232405 A1 * 10/2007 Halleck ..... A63B 69/3632 473/220
2009/0143158 A1 * 6/2009 Fidge ..... A63B 69/3614 473/238
2013/0296064 A1 * 11/2013 Ramey ..... A63B 69/3667 473/226

FOREIGN PATENT DOCUMENTS

KR 10-2010-0118410 A 11/2010
KR 10-1770089 B1 8/2017
KR 10-2257519 A 5/2021

* cited by examiner

*Primary Examiner* — Nini F Legesse
(74) *Attorney, Agent, or Firm* — Bridgeway IP Law Group, PLLC; Sang Ho Lee; Hyun Woo Shin

(57) ABSTRACT

A golf swing guide apparatus includes: a coupling body coupled to a shaft of a golf club; at least one display panel spaced apart from an outer circumferential surface of the shaft and disposed at a position where a user is able to visually check whether a position and direction of the golf club are correct in at least one of a plurality of golf swing stages when the user swings the golf club; and at least one connecting body coupling the at least one display panel to the coupling body.

17 Claims, 16 Drawing Sheets

(a)

(b)

(a)

(b)

GOLF SWING GUIDE APPARATUS

CROSS-REFERENCE TO RELATED APPLICATION

This application claims priority to Korean Patent Application No. 10-2022-0097268 filed on Aug. 4, 2022, in the Korean Intellectual Property Office, the disclosure of which is incorporated herein in its entirety by reference.

BACKGROUND

1. Field

The present disclosure relates to a golf swing guide apparatus, and more particularly, to a golf swing guide apparatus that allows advanced golfers as well as golf beginners to easily learn and maintain a correct swing posture and correct a swing posture through a simpler structure, without time and space restrictions.

2. Description of Related Art

Golf is a sport in which players use clubs to hit a stationary golf ball into a series of holes on a course, and superiority is determined by the number of strokes until entering the golf ball into certain holes. In a course that is generally composed of 18 holes, it is an important factor to have accuracy and directionality for each hole with difficulty by distance. To this end, a correct swing posture is required.

As golf has become popular in recent years, the golf population continues to increase. Accordingly, various types of golf swing guide apparatuses have been widely used in order for a user to learn various basic skills and techniques for playing golf and to master a correct swing posture.

In particular, various structures for a golf swing guide apparatus are already disclosed in order to correct a swing path of a golf club for each section in a stage of swinging a golf club, that is, a golf swing stage including address, takeaway, backswing, top of swing, downswing, impact, follow-through, and finish.

For example, Korean Patent Publication No. 10-2010-0118410 (Golf Swing Training Apparatus) (published on Nov. 5, 2010) discloses a structure of a golf swing training apparatus including a swing rail (10) (10') for guiding a swing path of a golf club, a support frame (20) for supporting the swing rail (10) (10'), and a club mounting part (50) (60) moving along the swing rail (10) (10') in a state where the golf club is fixed. Korean Patent Registration No. 10-1770089 (Golf Swing Posture Correction Apparatus) (published on Aug. 30, 2017) discloses a structure of a golf swing posture correction apparatus having a swing path rail (1) including a back swing path section (12), a back swing top path section (13), a down swing path section (14), an impact path section (15), a follow throw path section (16), and a finish path section (17).

However, since the golf swing guide apparatuses having the above-described structure require a lot of space to install the swing rail for correcting the user's swing path and most of them have a fixed structure, there has been great limitation in the time and place for swing training. In addition, the golf swing guide apparatuses having the above-described structure have a problem that the overall structure is complicated, and thus, the manufacturing cost and maintenance cost increase.

To solve these problems, the applicant of the present application obtained a patent for a golf swing practice apparatus (Korean Patent Registration No. 10-2257519 (Golf Swing Training Apparatus) (published on May 27, 2021), which includes only a body having a ring shape or an arc shape and a swing training bat (or golf club), wherein a user can easily check whether a swing posture is correct with his or her naked eye by using a plurality of display units formed at positions corresponding to the rotated angles of the body, based on the position of the swing training bat (or golf club) corresponding to each of a plurality of golf swing stages.

However, the golf swing training apparatus disclosed in Korean Patent Registration No. (Golf Swing Training Apparatus) (published on May 27, 2021) of the applicant of the present application has an advantage that can easily check the swing posture in the entire golf swing stage, but is cumbersome to accurately check the position and direction of the shaft constituting the golf club and the direction of the club face in each golf swing stage.

In particular, the golf swing training apparatus disclosed in Korean Patent Registration No. (Golf Swing Training Apparatus) (published on May 27, 2021) of the applicant of the present application is insufficient to confirm correct swing paths in address, takeaway, impact, and follow-through, which are considered as being the most important in the entire golf swing stages.

Therefore, there is a need for a golf swing guide apparatus that allows advanced golfers as well as golf beginners to easily learn and maintain a correct swing posture and correct a swing posture through a simpler structure, without time and space restrictions.

CITATION LIST

Patent Literature

Korean Patent Publication No. 10-2010-0118410 (Golf Swing Training Apparatus) (published on Nov. 5, 2010)

Korean Patent Registration No. 10-1770089 (Golf Swing Posture Correction Apparatus) (published on Aug. 30, 2017) Korean Patent Registration No. 10-2257519 (Golf Swing Training Apparatus) (published on May 27, 2021)

SUMMARY

The present disclosure has been made in an effort to solve the above problems, and aims to provide a golf swing guide apparatus in which a display panel that allows a user to visually check whether a position and direction of a golf club is correct in a golf swing stage when the user swings the golf club is disposed at a position spaced apart from and parallel to a shaft of the golf club, so that advanced golfers as well as golf beginners can easily learn and maintain a correct swing posture and correct a swing posture through a simpler structure, without time and space restrictions.

The objects of the present disclosure are not limited to the above object, and other objects that are not mentioned herein will be clearly understood by those of ordinary skill in the art from the following description.

In order to achieve the above object, a golf swing guide apparatus according to embodiments of the present disclosure includes: a coupling body coupled to a shaft of a golf club; at least one display panel spaced apart from an outer circumferential surface of the shaft and disposed at a position where a user is able to visually check whether a position and direction of the golf club are correct in at least one of a plurality of golf swing stages when the user swings the golf club; and at least one connecting body coupling the at least one display panel to the coupling body.

Each of the at least one display panel is spaced apart from the outer circumferential surface of the shaft so as to be parallel to a longitudinal direction of the shaft, and one surface of each of the at least one display panel on which an identification mark that the user visually checks in order to determine whether the position and direction of the golf club are correct is displayed is disposed parallel or perpendicular to a club face of the golf club.

For example, each of the at least one connecting body includes: a first connecting body having one end coupled to one side of the coupling body and the other end protruding from one side of the coupling body in a direction perpendicular to a longitudinal direction of the shaft; and a second connecting body having one end coupled to the other end of the first connecting body and spaced apart from the outer circumferential surface of the shaft so as to be parallel to the longitudinal direction of the shaft, and each of the at least one display panel is coupled to one side of the second connecting body provided in each of the at least one connecting body.

As another example, each of the at least one connecting body includes: a first connecting body having one end coupled to one side of the coupling body and the other end protruding from one side of the coupling body in a first direction perpendicular to a longitudinal direction of the shaft and then bent in a second direction perpendicular to the first direction body; and a second connecting body having one end coupled to the other end of the first connecting body and spaced apart from the outer circumferential surface of the shaft so as to be parallel to the longitudinal direction of the shaft, and each of the at least one display panel is coupled to one side of the second connecting body provided in each of the at least one connecting body.

On the other hand, the second connecting body provided in each of the at least one connecting body is rotatably coupled to the other end of the first connecting body provided in each of the at least one connecting body, such that at least one of a vertical angle and a horizontal angle of each of the at least one display panel is adjustable.

In addition, the second connecting body provided in each of the at least one connecting body is adjustable in length in the longitudinal direction of the shaft from the other end of the first connecting body provided in each of the at least one connection body, such that a position of each of the at least one display panel is adjustable.

On the other hand, in order to achieve the above object, a golf swing guide apparatus according to a first embodiment of the present disclosure includes: a coupling body detachably coupled to a shaft of a golf club; a display panel spaced apart from an outer circumferential surface of the shaft so as to be parallel to a club face of the golf club, and disposed at a position where a user is able to visually check whether a position and direction of the shaft and a direction of the club face are correct in takeaway or follow-through among a plurality of golf swing stages when the user swings the golf club; a first connecting body having one end coupled to one side of the coupling body and the other end protruding from one side of the coupling body in a direction perpendicular to a longitudinal direction of the shaft; and a second connecting body having one end coupled to the other end of the first connection body, spaced apart from the outer circumferential surface of the shaft so as to be parallel to the longitudinal direction of the shaft, and to which the display panel is coupled to one side.

On the other hand, in order to achieve the above object, a golf swing guide apparatus according to a second embodiment of the present disclosure includes: a coupling body detachably coupled to a shaft of a golf club; a display panel spaced apart from an outer circumferential surface of the shaft so as to be parallel to a club face of the golf club, and disposed at a position where a user is able to visually check whether a position and direction of the shaft and a direction of the club face are correct in takeaway or follow-through among a plurality of golf swing stages when the user swings the golf club; a first connecting body having one end coupled to one side of the coupling body and the other end protruding from one side of the coupling body in a first direction perpendicular to a longitudinal direction of the shaft and then bent in a second direction perpendicular to the first direction body; and a second connecting body having one end coupled to the other end of the first connecting body, and spaced apart from the outer circumferential surface of the shaft so as to be parallel to the longitudinal direction of the shaft, the display panel being coupled to one side of the second connecting body.

On the other hand, in order to achieve the above object, a golf swing guide apparatus according to a third embodiment of the present disclosure includes: a coupling body detachably coupled to a shaft of a golf club; a display panel spaced apart from an outer circumferential surface of the shaft so as to be parallel to a club face of the golf club, and disposed at a position where a user is able to visually check whether a position and direction of the shaft and a direction of the club face are correct in address or impact among a plurality of golf swing stages when the user swings the golf club; a first connecting body having one end coupled to one side of the coupling body and the other end protruding from one side of the coupling body in a first direction perpendicular to a longitudinal direction of the shaft and then bent in a second direction perpendicular to the first direction body; and a second connecting body having one end coupled to the other end of the first connecting body, and spaced apart from the outer circumferential surface of the shaft so as to be parallel to the longitudinal direction of the shaft, the display panel being coupled to one side of the second connecting body.

Specific matters of other embodiments are included in the detailed description and drawings.

ADVANTAGEOUS EFFECTS

In a golf swing guide apparatus according to embodiments of the present disclosure, a display panel that allows a user to visually check whether a position and direction of a golf club is correct in a golf swing stage when the user swings the golf club is disposed at a position spaced apart from and parallel to a shaft of the golf club. Therefore, advanced golfers as well as golf beginners can easily learn and maintain a correct swing posture and correct a swing posture through a simpler structure, without time and space restrictions.

In particular, the golf swing guide apparatus according to the embodiments of the present disclosure allows the user to visually confirm the display panel disposed at a position spaced apart from and parallel to the shaft of the golf club. Therefore, the correct swing path can be secured in address, takeaway, impact, and follow-through, which are considered to be the most important in the entire golf swing, through a simpler structure.

In addition, in the golf swing guide apparatus according to embodiments of the present disclosure, one surface on which the identification mark of the display panel spaced apart from the outer circumferential surface of the shaft so as to be parallel to the longitudinal direction of the shaft is displayed is disposed parallel or perpendicular to the club face of the golf club. Therefore, the user can visually check whether the position and direction of the shaft constituting the golf club are correct in the golf swing stage when the user swings the golf club.

The effects of the present disclosure are not limited to the above objects, and other objects that are not mentioned herein will be clearly understood by those of ordinary skill in the art from the claims.

DETAILED DESCRIPTION

Figure 1:
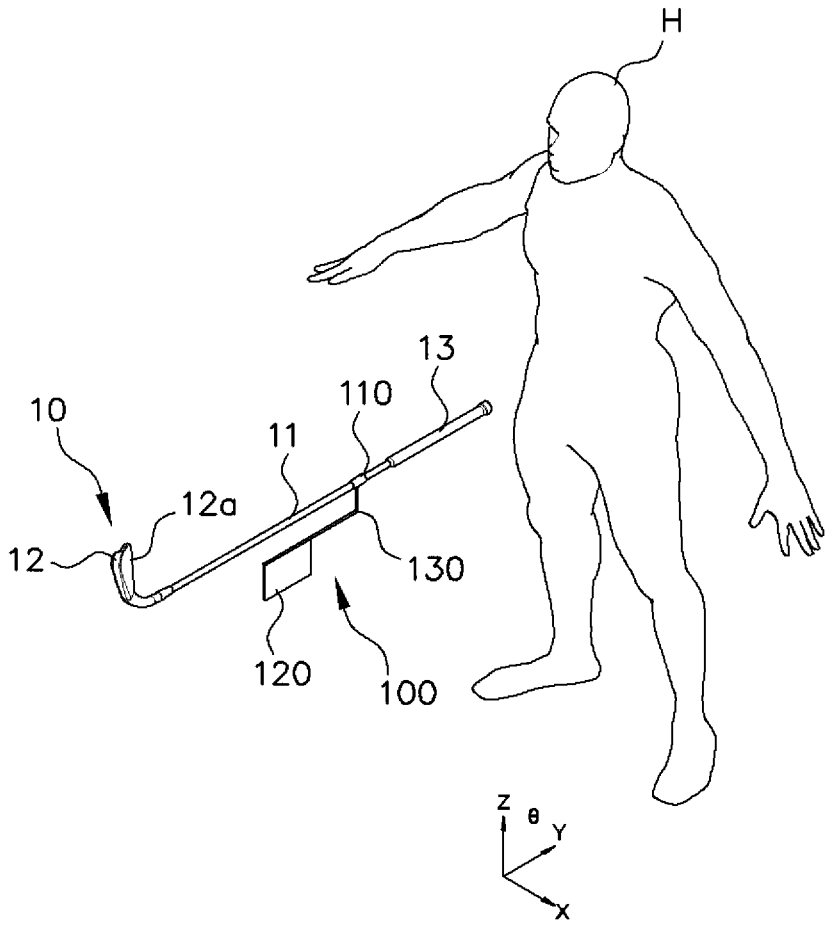
FIG. 1 is a perspective view schematically showing a structure of a golf swing guide apparatus according to a first embodiment of the present disclosure.

Hereinafter, preferred embodiments of the present disclosure will be described with reference to the accompanying drawings, so that those of ordinary skill in the art can easily carry out the present disclosure.

In describing the embodiments, descriptions of technical contents that are well known in the technical field to which the present disclosure pertains and are not directly related to the present disclosure will be omitted. By omitting unnecessary description, the disclosure may be described more clearly without obscuring the gist of the disclosure.

For the same reason, some elements in the accompanying drawings are exaggerated, omitted, or schematically illustrated. Also, the size of each element does not entirely reflect the actual size. The same reference numerals are assigned to the same or corresponding elements in the drawings.

In addition, the expressions and predicates used herein with respect to the terms such as device or element directions (for example, "front", "back", "up", "down", "top", "bottom", "left", "right", "lateral", and the like) are only used to simplify the description of the present disclosure, and do not simply indicate or imply that the related device or element should have a particular direction.

Hereinafter, a golf swing guide apparatus 100 according to embodiments of the present disclosure will be described with reference to the drawings.

Figure 2:
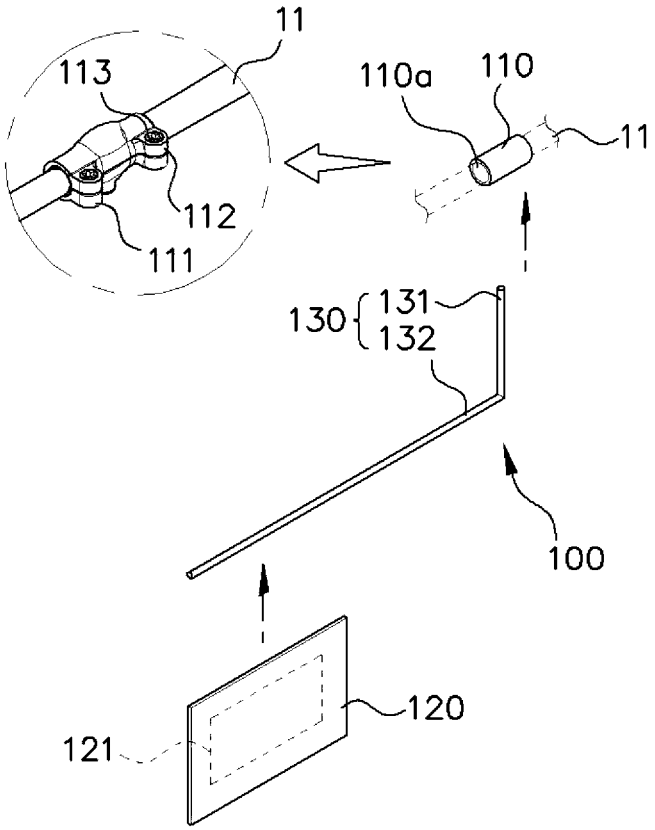
FIG. 2 is an exploded perspective view schematically showing the structure of the golf swing guide apparatus according to the first embodiment of the present disclosure.
Figure 3:
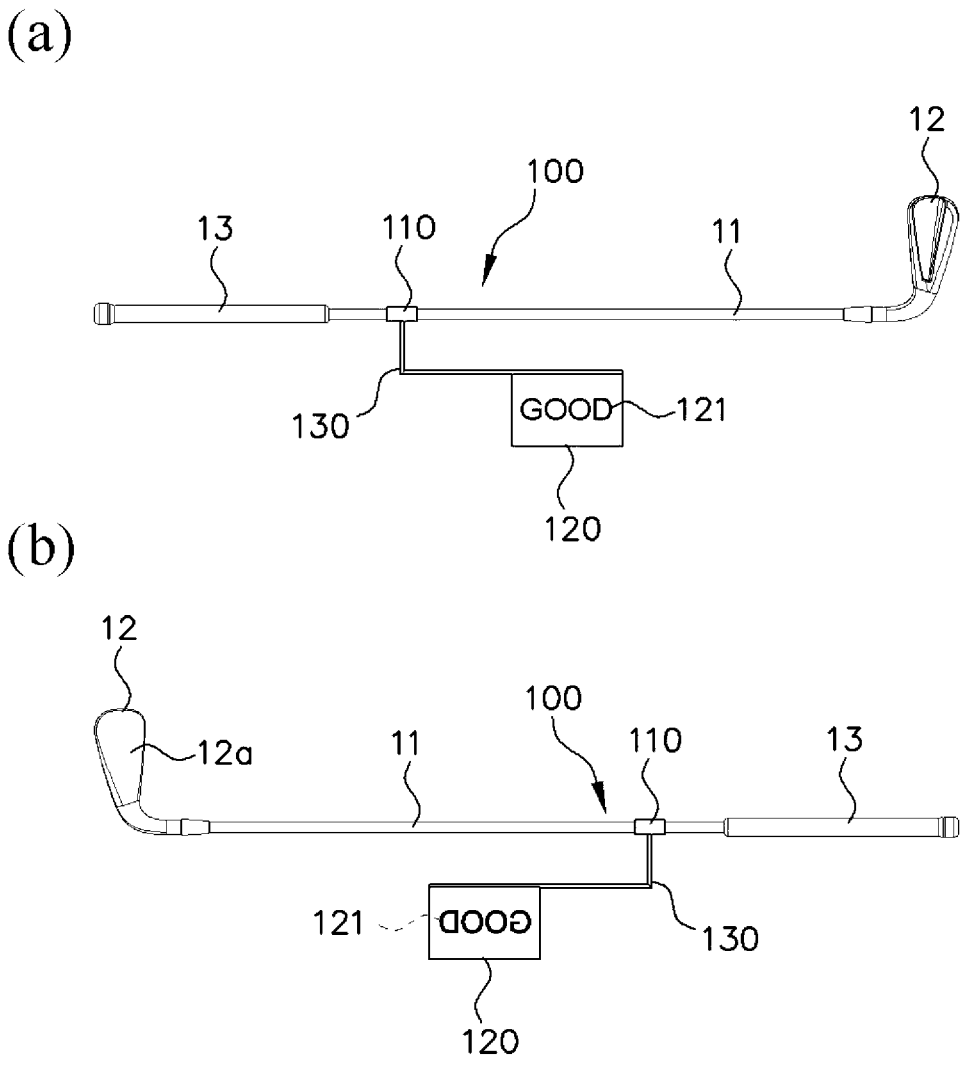
FIG. 3 is a plan view schematically showing the structure of the golf swing guide apparatus according to the first embodiment of the present disclosure.

FIG. 1 is a perspective view schematically showing a structure of a golf swing guide apparatus according to a first embodiment of the present disclosure, FIG. 2 is an exploded perspective view schematically showing the structure of the golf swing guide apparatus according to the first embodiment of the present disclosure, and FIG. 3 is a plan view schematically showing the structure of the golf swing guide apparatus according to the first embodiment of the present disclosure.

As shown in FIGS. 1 to 3, the golf swing guide apparatus 100 according to the first embodiment of the present disclosure may be configured to include a coupling body 110, a display panel 120, and a connecting body 130.

The golf swing guide apparatus 100 according to the first embodiment of the present disclosure may be used to check whether a position and direction of a golf club 10, that is, a position and direction of a shaft 11 and a direction of a club face 12*a* are correct in takeaway or follow-through among a plurality of golf swing stages when a user swings the golf club 10.

The coupling body 110 may be detachably coupled to the shaft 11 of the golf club 10. Preferably, the coupling body 110 may be coupled to the shaft 11 at a position adjacent to a grip 13 of the golf club 10.

As shown in FIG. 2, the coupling body 110 may have a substantially cylindrical shape, and may have a hollow portion 110*a* formed to surround the outer circumferential surface of the shaft 11. At this time, the coupling body 110 may include a first coupling body 111 having a semicircular cross-section and coupled to one side of the outer circumferential surface of the shaft 11, a second coupling body 112 having a semicircular cross-section and coupled to the other side of the outer circumferential surface of the shaft 11, and a fastening member 113 for fastening the first coupling body 111 to the second coupling body 112.

As shown in FIGS. 1 and 3, the display panel 120 may have a thin plate shape and may be disposed in a direction parallel to the longitudinal direction of the shaft 11 at a position spaced apart from the outer circumferential surface of the shaft 11.

Preferably, the display panel 120 may be disposed at a position where a user can visually check whether the position and direction of the golf club 10 are correct in at least one of a plurality of golf swing stages when the user swings the golf club 10.

In particular, the display panel 120 constituting the golf swing guide apparatus 100 according to the first embodiment of the present disclosure may be disposed such that the surface on which an identification mark 121 is displayed and the shaft 11 are positioned on the same plane in a state of being spaced apart from the outer circumferential surface of the shaft 11.

In addition, the display panel 120 may display the identification mark 121 on one surface in a direction facing the user's eyes when the golf club 10 is positioned in the golf swing stage to check whether the position and direction of the golf club 10 is correct.

As shown in FIGS. 2 and 3, the golf club 10 is located on the user's right side in takeaway. Therefore, when the user wants to check whether the position and direction of the golf club 10 are correct in takeaway, the display panel 120 may display the identification mark 121 (the English letter 'GOOD' in the example of FIG. 3) on one surface positioned on the right side of the shaft 11.

Although not shown, the golf club 10 is located on the user's right side in follow-through. Therefore, when the user wants to check whether the position and direction of the golf club 10 is correct in follow throw, the display panel 120 may display an identification mark (not shown) on one side positioned on the left side of the shaft 11.

Figure 5:
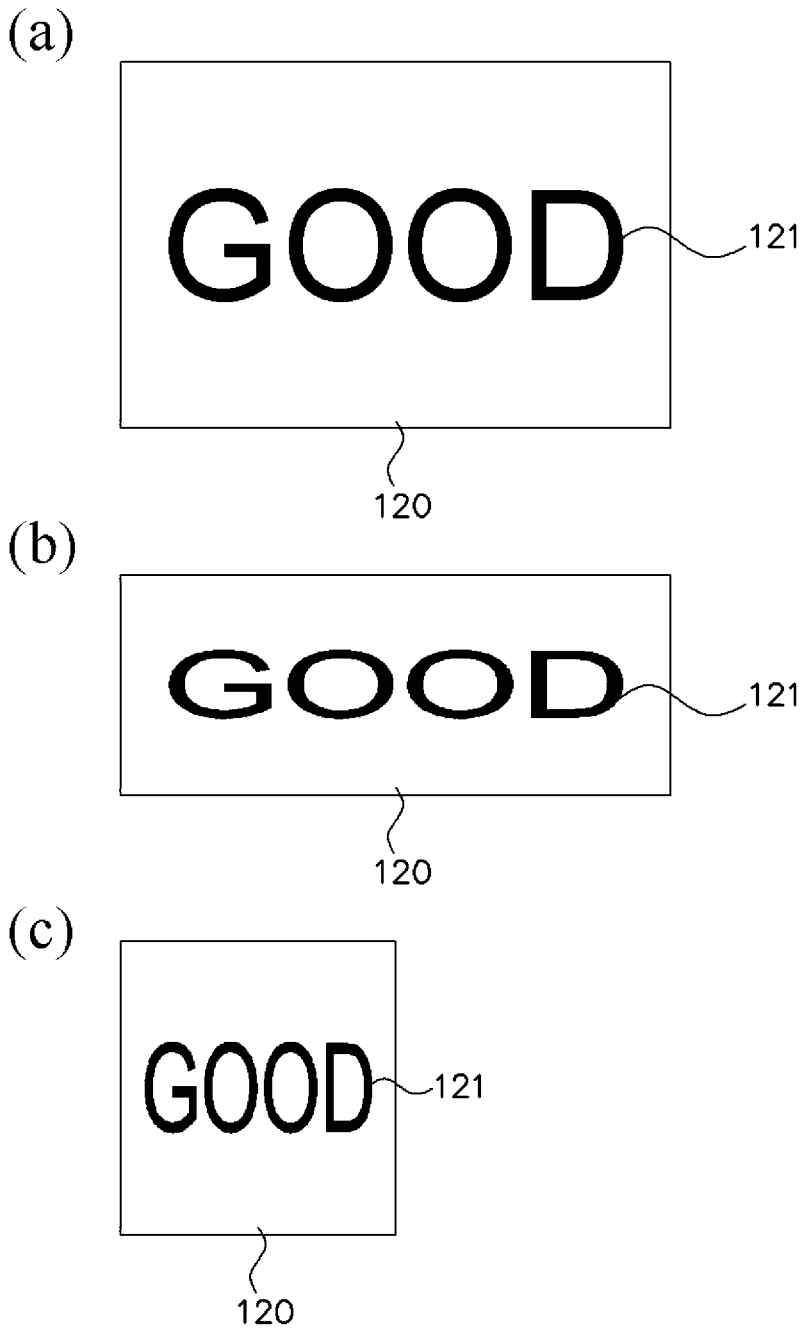
FIG. 5 is a view showing an example in which a user visually confirms an identification mark according to a position and direction of a shaft, wherein the identification mark is displayed on a display panel constituting the golf swing guide apparatus according to the first embodiment of the present disclosure in the example shown in FIG. 4.

On the other hand, FIG. 5 shows an example of using characters as the identification mark 121 displayed on the display panel 120, but the present disclosure is not limited thereto, and a figure, a hologram, or the like having a certain size and shape may also be used.

On the other hand, the display panel 120 may be spaced apart from the outer circumferential surface of the shaft 11 so as to be parallel to the longitudinal direction of the shaft 11. One surface on which the identification mark 121 that the user visually confirms in order to determine whether the position and direction of the golf club 10 is correct is displayed may be disposed parallel or perpendicular to the club face 12*a* of the golf club 10.

Preferably, the display panel 120 constituting the golf swing guide apparatus 100 according to the first embodiment of the present disclosure may be disposed such that one surface on which the identification mark 121 is displayed is parallel to the club face 12*a*.

That is, as shown in FIGS. 1 to 3, in takeaway, the golf club 10 has to be located on the user's right side and the club face 12*a* has to be disposed parallel to the user's spine angle (see (a) of FIG. 5). Therefore, when the user wants to check whether the position and direction of the golf club 10 is correct in takeaway, the display panel 120 is preferably disposed such that one surface on which the identification mark 121 is displayed is parallel to the club face 12*a*.

On the other hand, FIGS. 1 to 3 illustrates an example in which the display panel 120 is disposed under the shaft 11 such that one surface on which the identification mark 121 is displayed is located on the same plane as the shaft 11 and is disposed parallel to the club face 12*a*, but the display panel 120 may be disposed on the shaft 11 if necessary.

As shown in FIG. 2, the connecting body 130 may couple the display panel 120 to the coupling body 110. As shown in FIG. 2, the connecting body 130 may include a first connecting body 131 coupled to the coupling body 110, and a second connecting body 132 coupled to the display panel 120.

The first connecting body 131 may have one end coupled to one side of the coupling body 110, and the other end protruding from one side of the coupling body 110 in a direction perpendicular to the longitudinal direction of the shaft 11. In addition, the second connecting body 132 may have one end coupled to the other end of the first connecting body 131, and may be spaced apart from the outer circumferential surface of the shaft 11 so as to be parallel to the longitudinal direction of the shaft 11. Accordingly, the connecting body 130 may be formed to have a '¬' shape as a whole. In addition, the display panel 120 may be coupled to one side of the second connecting body 132.

On the other hand, FIG. 2 shows an example in which one end of the first connecting body 131 is coupled to the coupling body 110 and the display panel 120 is coupled to one side of the second connecting body 132 in a state where the first connecting body 131 and the second connecting body 132 are coupled to each other in a '¬' shape, but the first connecting body 131 and the coupling body 110 may be integrally formed as a single body, or the second connecting body 132 and the display panel 120 may be integrally formed as a single body.

Hereinafter, an example of checking whether the position and direction of the golf club 10 is correct in takeaway or follow throw by using the golf swing guide apparatus 100 according to the first embodiment of the present disclosure will be described with reference to FIGS. 4 to 7. For convenience of description, an example of checking whether the position and direction of the golf club 10 are correct in takeaway will be described with reference to FIGS. 4 to 7.

Figure 4:
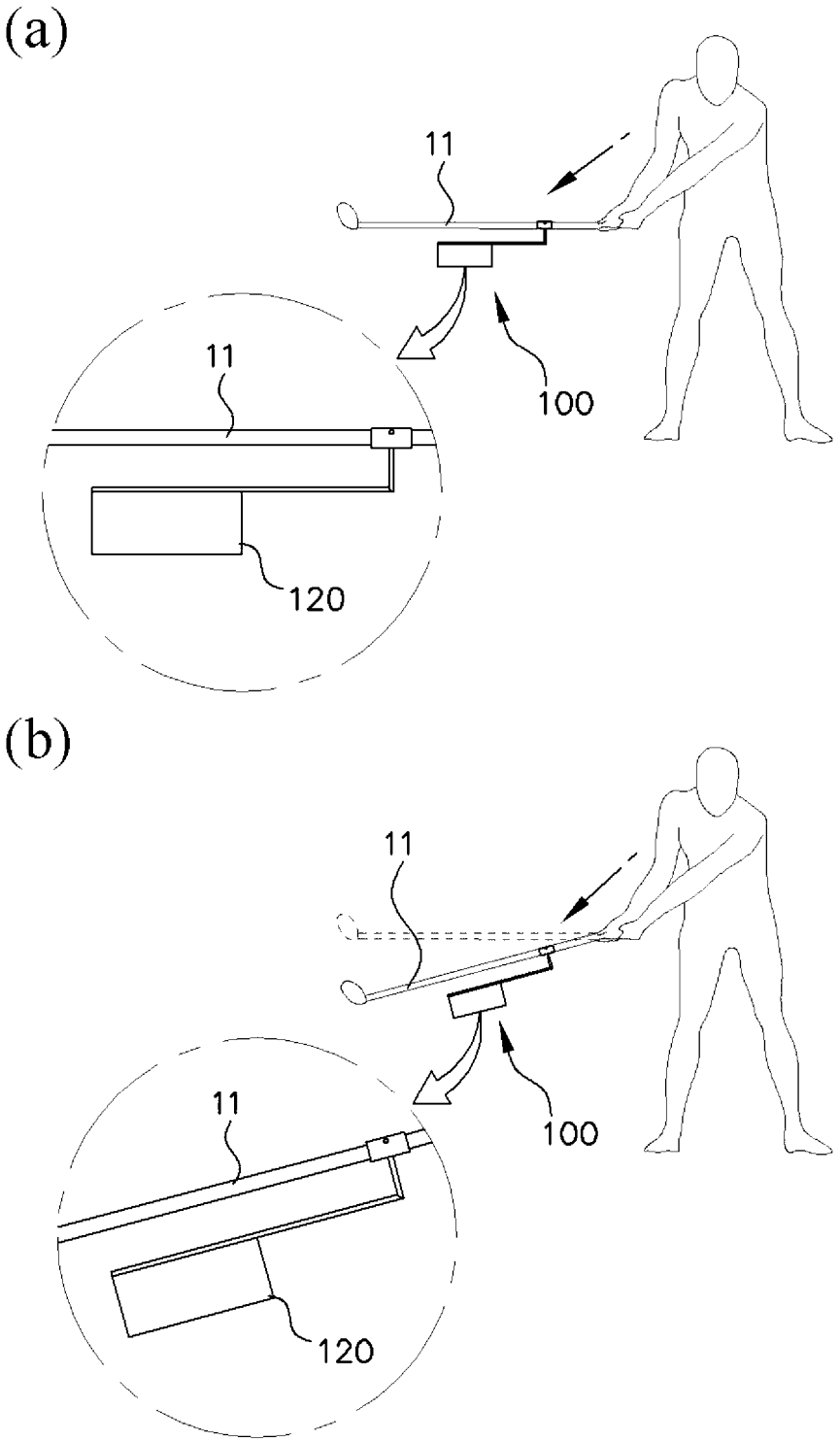
FIG. 4 is a front view showing a state where a golf swing posture is checked in takeaway by using the golf swing guide apparatus according to the first embodiment of the present disclosure.

FIG. 4 is a front view showing a state where a golf swing posture is checked in takeaway by using the golf swing guide apparatus according to the first embodiment of the present disclosure, and FIG. 5 is a view showing an example in which a user visually confirms an identification mark according to the position and direction of the shaft, wherein the identification mark is displayed on the display panel constituting the golf swing guide apparatus according to the first embodiment of the present disclosure in the example shown in FIG. 4.

(a) of FIG. 4 shows a case where the position and direction of the shaft 11 are correct in takeaway, and (b) of FIG. 4 shows a case where the position and direction of the shaft 11 are incorrect in takeaway.

In addition, (a) of FIG. 5 shows an example of the identification mark 121 displayed on one surface of the display panel 120, (b) of FIG. 5 shows an example in which the user visually confirms the identification mark 121 displayed on one side of the display panel 120 when the position and direction of the shaft 11 are correct in takeaway, and (c) of FIG. 5 shows an example in which the user visually confirms the identification mark 121 displayed on one side of the display panel 120 when the position and direction of the shaft 11 are incorrect in takeaway.

That is, the identification mark 121 of the display panel 120 shown in (a) of FIG. 5 is recognized with a different aspect ratio by the user's naked eye according to the position and direction of the shaft 11 in takeaway, and the user can easily check whether the position and direction of the shaft 11 are correct by visually confirming the identification mark 121 displayed on one surface of the display panel 120.

Figure 6:
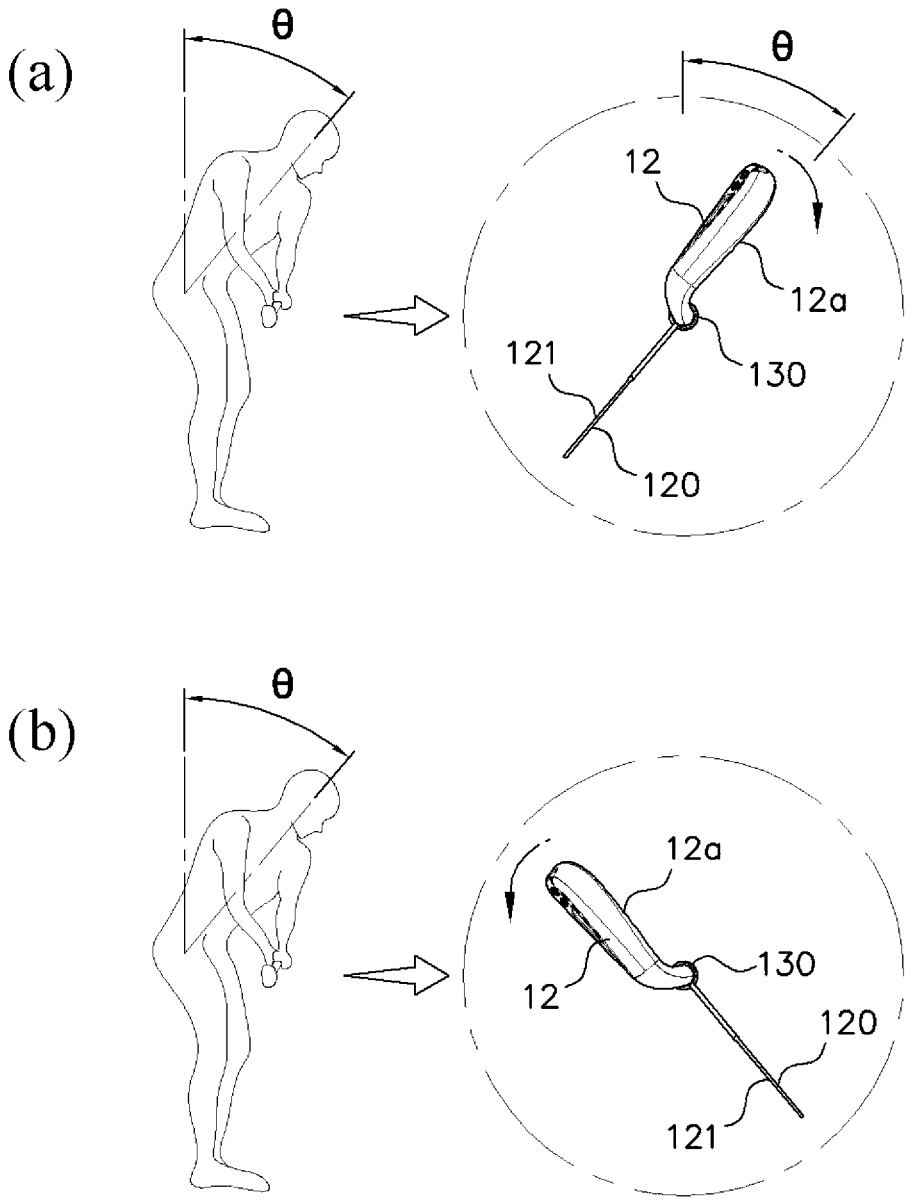
FIG. 6 is a side view showing a state where a golf swing posture is checked in takeaway by using the golf swing guide apparatus according to the first embodiment of the present disclosure.
Figure 7:
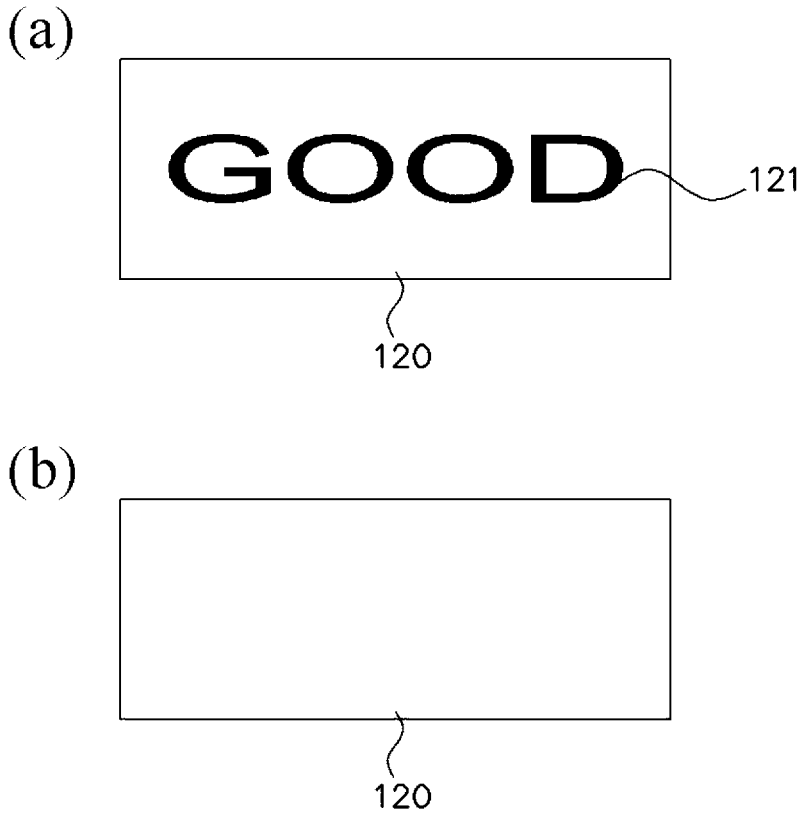
FIG. 7 is a view showing an example in which a user visually confirms an identification mark according to a direction of a club face, wherein the identification mark is displayed on the display panel constituting the golf swing guide apparatus according to the first embodiment of the present disclosure in the example shown in FIG. 4.

FIG. 6 is a side view showing a state where a golf swing posture is checked in takeaway by using the golf swing guide apparatus according to the first embodiment of the present disclosure, and FIG. 7 is a view showing an example in which a user visually confirms an identification mark according to the direction of the club face, wherein the identification mark is displayed on the display panel constituting the golf swing guide apparatus according to the first embodiment of the present disclosure in the example shown in FIG. 4.

(a) of FIG. 6 shows a case where the direction of the club face 12*a* is correct in takeaway, and (b) of FIG. 6 shows a case where the direction of the club face 12*a* is incorrect in takeaway.

In addition, (a) of FIG. 5 shows an example in which the user visually confirms the identification mark 121 displayed on one surface of the display panel 120 when the direction of the club face 12*a* is correct in takeaway, that is, when the club face 12*a* is disposed parallel to the user's spine angle, and (b) of FIG. 5 shows an example in which the user visually confirms the identification mark 121 displayed on one surface of the display panel 120 when the direction of the club face 12*a* is wrong in takeaway, for example, when the club face 12*a* is excessively opened.

That is, the identification mark 121 of the display panel 120 shown in (a) of FIG. 5 may or may not be recognized by the user's naked eye according to the direction of the club face 12*a* in takeaway, and the user can easily check whether the direction of the club face 12*a* is correct by visually confirming the identification mark 121 displayed on one surface of the display panel 120.

On the other hand, only an example of confirming whether the position and direction of the golf club 10 is correct in takeaway is described in FIGS. 4 to 7, but the examples shown in FIGS. 4 to 7 can be applied substantially equally to follow throw. However, the golf club 10 is located on the user's right side in follow-through. Therefore, in order for applying to follow throw, an identification mark (not shown) in the example of FIGS. 2 and (b) of FIG. 3 has to be displayed on one surface located on the left side of the shaft 11.

On the other hand, the display panel 120 constituting the golf swing guide apparatus 100 according to the first embodiment of the present disclosure may be configured to be adjustable in position and angle if necessary.

Figure 8:
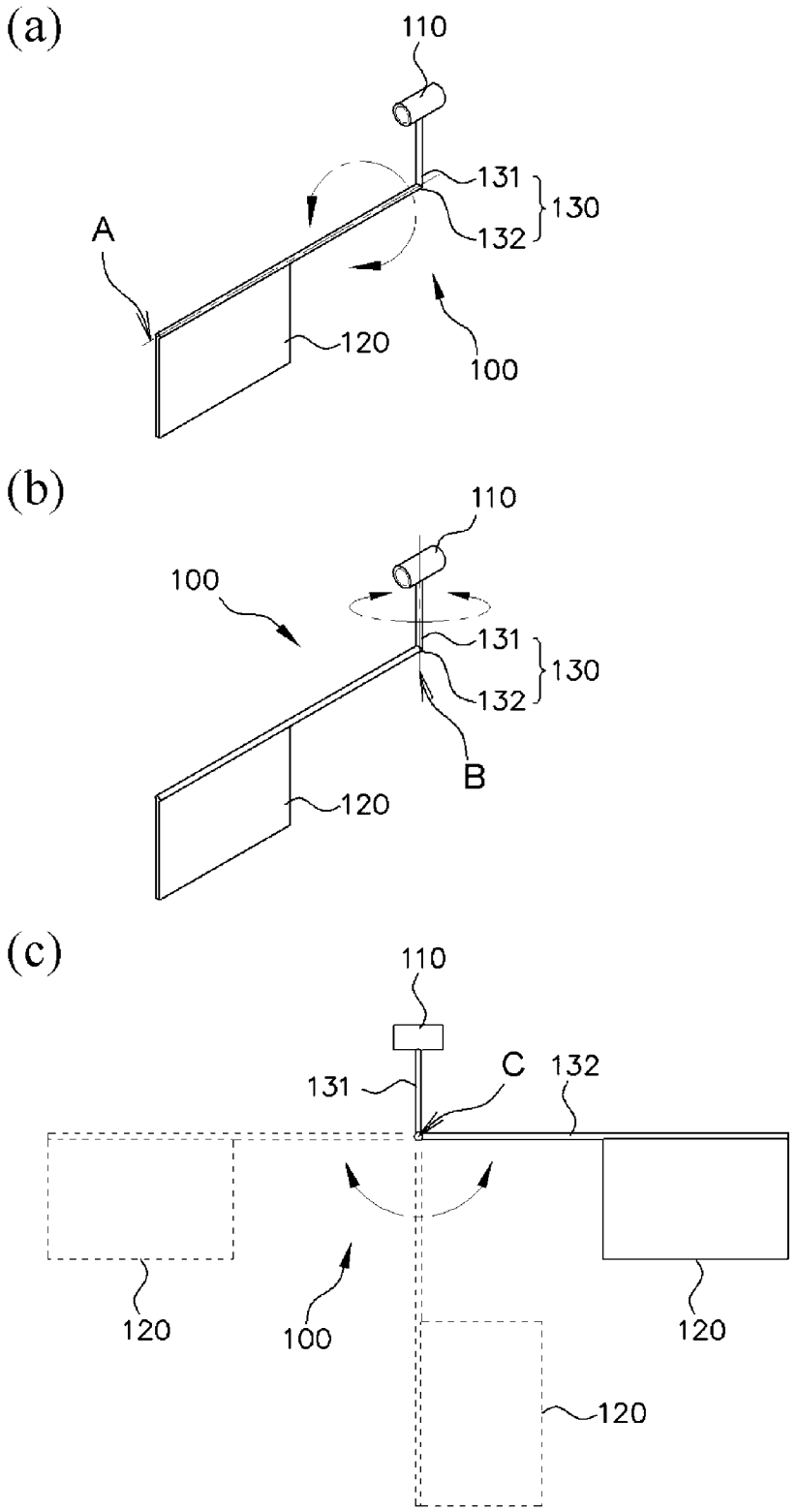
FIG. 8 is a view schematically showing a structure in which a second connecting body constituting the golf swing guide apparatus according to the first embodiment of the present disclosure is rotatably coupled.
Figure 9:
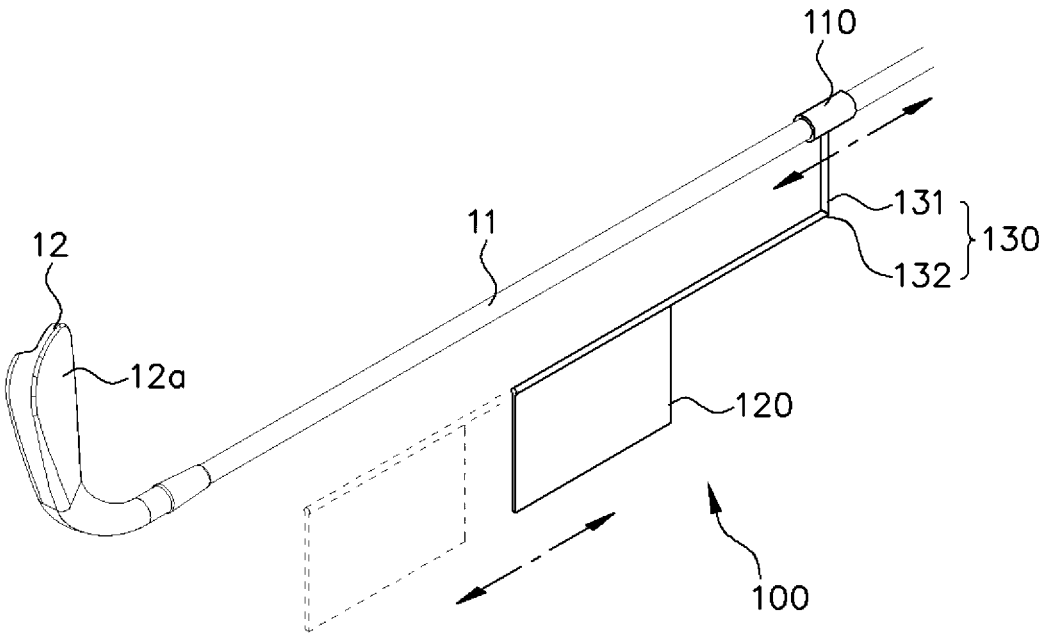
FIG. 9 is a view schematically showing a structure in which the second connecting body constituting the golf swing guide apparatus according to the first embodiment of the present disclosure is configured to be adjustable in length.

FIG. 8 is a view schematically showing a structure in which a second connecting body constituting the golf swing guide apparatus according to the first embodiment of the present disclosure is rotatably coupled, and FIG. 9 is a view schematically showing a structure in which the second connecting body constituting the golf swing guide apparatus according to the first embodiment of the present disclosure is configured to be adjustable in length.

First, in (a) to (c) of FIG. 8 shows a structure in which the angle of the display panel 120 is adjustable. As shown in (a) to (c) of FIG. 8, the second connecting body 132 constituting the connecting body 130 may be rotatably coupled to the other end of the first connecting body 131 so as to adjust at least one of the vertical angle and the horizontal angle of the display panel 120.

(a) of FIG. 8 shows a structure in which the display panel 120 is rotatable about a first axis A that coincides with the longitudinal direction of the second connecting body 132, (b) of FIG. 8 shows a structure in which the display panel 120 is rotatable about a second axis B that coincides with the longitudinal direction of the first connecting body 131, and (c) of FIG. 8 shows a structure in which the display panel 120 is rotatable about a third axis C perpendicular to the longitudinal direction of the first connecting body 131 and the longitudinal direction of the second connecting body 132.

In addition, FIG. 9 shows a structure in which the position of the display panel 120 is adjustable. As shown in FIG. 9, the second connecting body 132 may have a structure in which the length thereof is adjustable in the longitudinal direction of the shaft 11 from the other end of the first connecting body 131, so that the position of the display panel 120 is adjustable.

Accordingly, the position and angle of the display panel 120 constituting the golf swing guide apparatus 100 according to the first embodiment of the present disclosure are adjustable according to the user's body type, the type of the golf club 10, and the like.

Hereinafter, a structure of a golf swing guide apparatus 100 according to a second embodiment of the present disclosure will be described with reference to FIGS. 10 to 12. For convenience of description, a description of the same structure as that of the first embodiment shown in FIGS. 1 to 9 will be omitted, and only differences will be described below.

Figure 10:
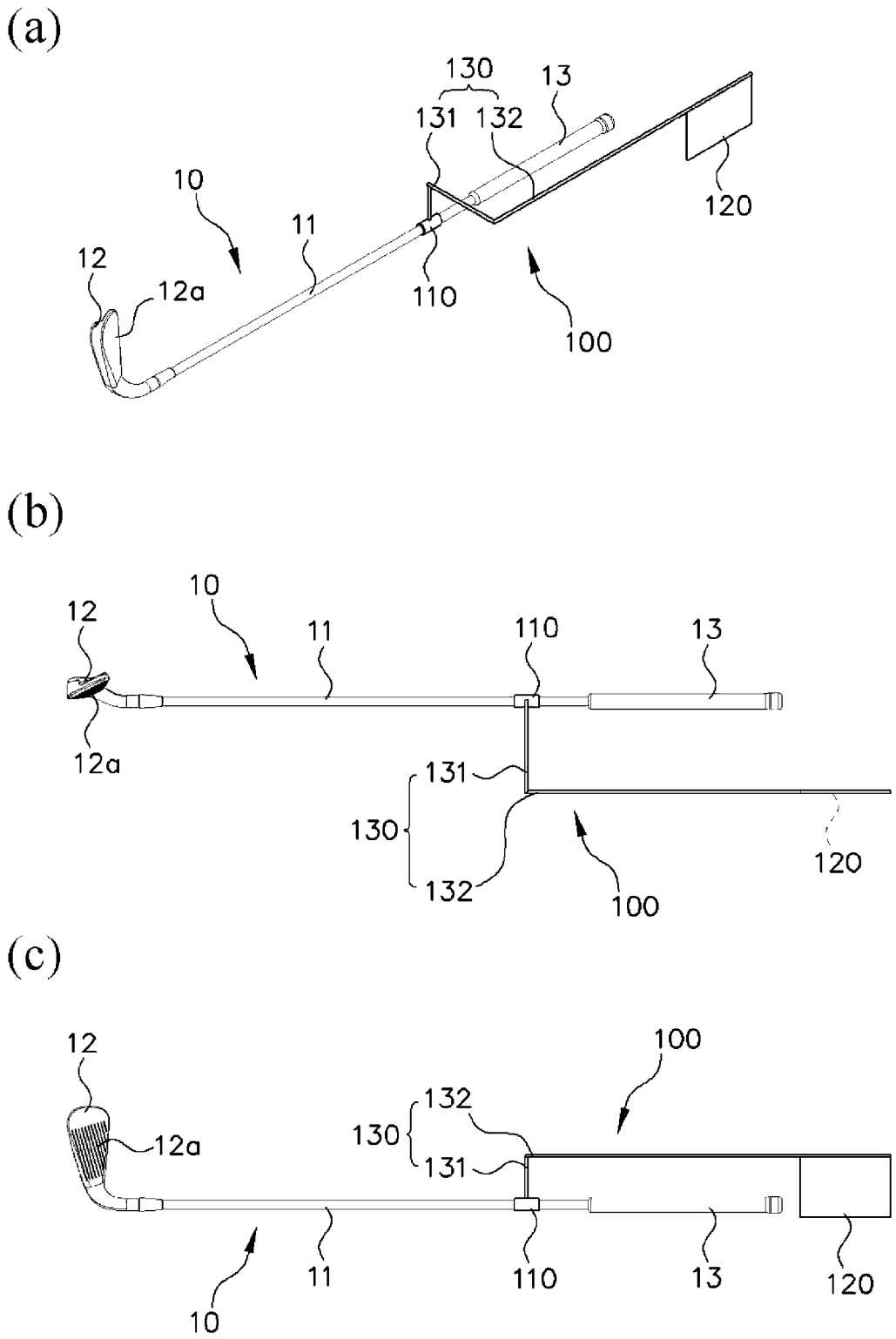
FIG. 10 is a view schematically showing a structure of a golf swing guide apparatus according to a second embodiment of the present disclosure.

FIG. 10 is a view schematically showing the structure of the golf swing guide apparatus according to the second embodiment of the present disclosure.

The golf swing guide apparatus 100 according to the second embodiment of the present disclosure may be used to check whether a position and direction of a golf club 10, that is, a position and direction of a shaft 11 and a direction of a club face 12*a* are correct in takeaway or follow-through among a plurality of golf swing stages when a user swings the golf club 10.

(a) to (c) of FIG. 10 are a perspective view, a plan view, and a side view of the golf swing guide apparatus 100 according to the second embodiment of the present disclosure, respectively.

As shown in FIG. 10, the golf swing guide apparatus 100 according to the second embodiment of the present disclosure differs from the first embodiment shown in FIGS. 1 to 9 in which the surface on which the identification mark 121 is displayed and the shaft 11 are located on the same plane, in that the display panel 120 is disposed such that one surface on which the identification mark 121 is displayed is disposed on a different plane from the shaft 11 in a state of being spaced part from the outer circumferential surface of the shaft 11.

As shown in FIG. 10, the display panel 120 constituting the golf swing guide apparatus 100 according to the second embodiment of the present disclosure may be disposed such that one surface on which the identification mark 121 is displayed is spaced apart from the outer circumferential surface of the shaft 11. Preferably, the display panel 120 may be disposed at a position adjacent to the grip 13 of the golf club 10 at the rear end of the coupling body 110, such that one side on which the identification mark 121 is displayed is located close to the lower portion of the user's face.

In addition, as shown in FIG. 10, the first connecting body 131 constituting the connecting body 130 may have one end coupled to one side of the coupling body 110, and the other end protruding from one side of the coupling body 110 in a first direction perpendicular to the longitudinal direction of the shaft 11 and bent in a second direction perpendicular to the longitudinal direction and the first direction. That is, the first connecting body 131 may be formed to have an approximately '¬' shape from one side of the coupling body 110.

In addition, the second connecting body 132 may have one end coupled to the other end of the first connecting body 131, and may be spaced apart from the outer circumferential surface of the shaft 11 so as to be parallel to the longitudinal direction of the shaft 11, and the display panel 120 may be coupled to one side thereof.

Figure 11:
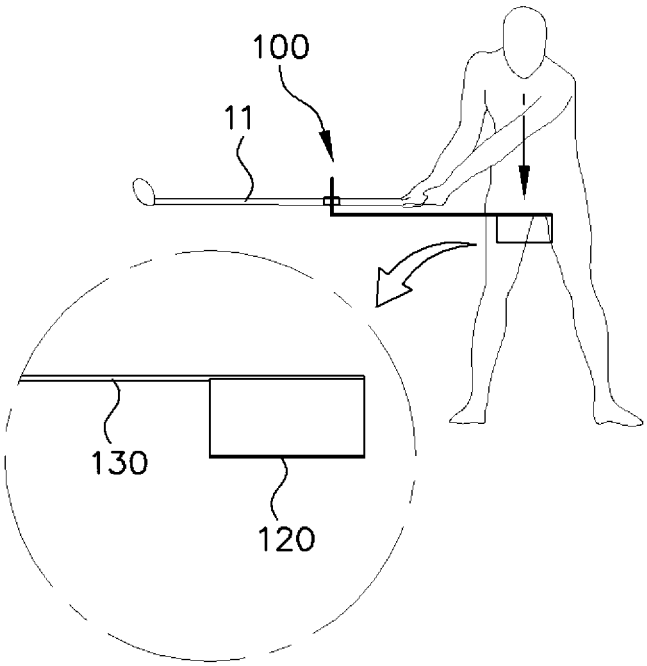
FIG. 11 is a front view showing a state where a golf swing posture is checked in takeaway by using the golf swing guide apparatus according to the second embodiment of the present disclosure.
Figure 11:
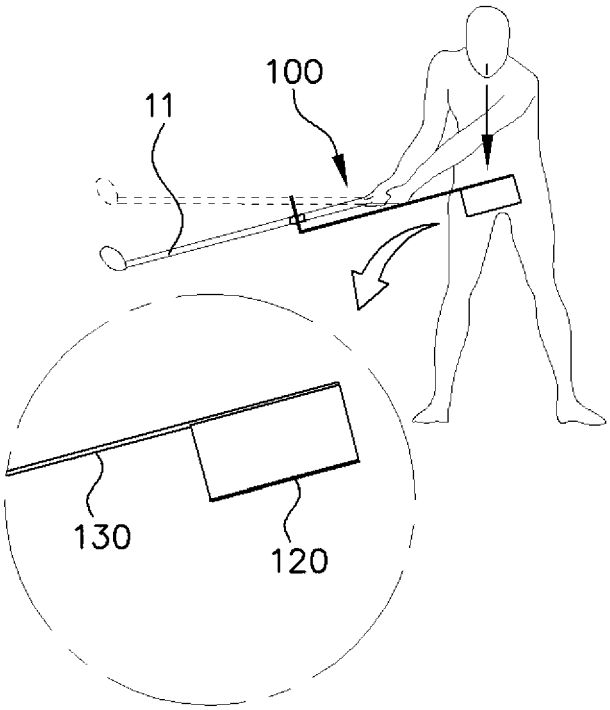
Figure 12:
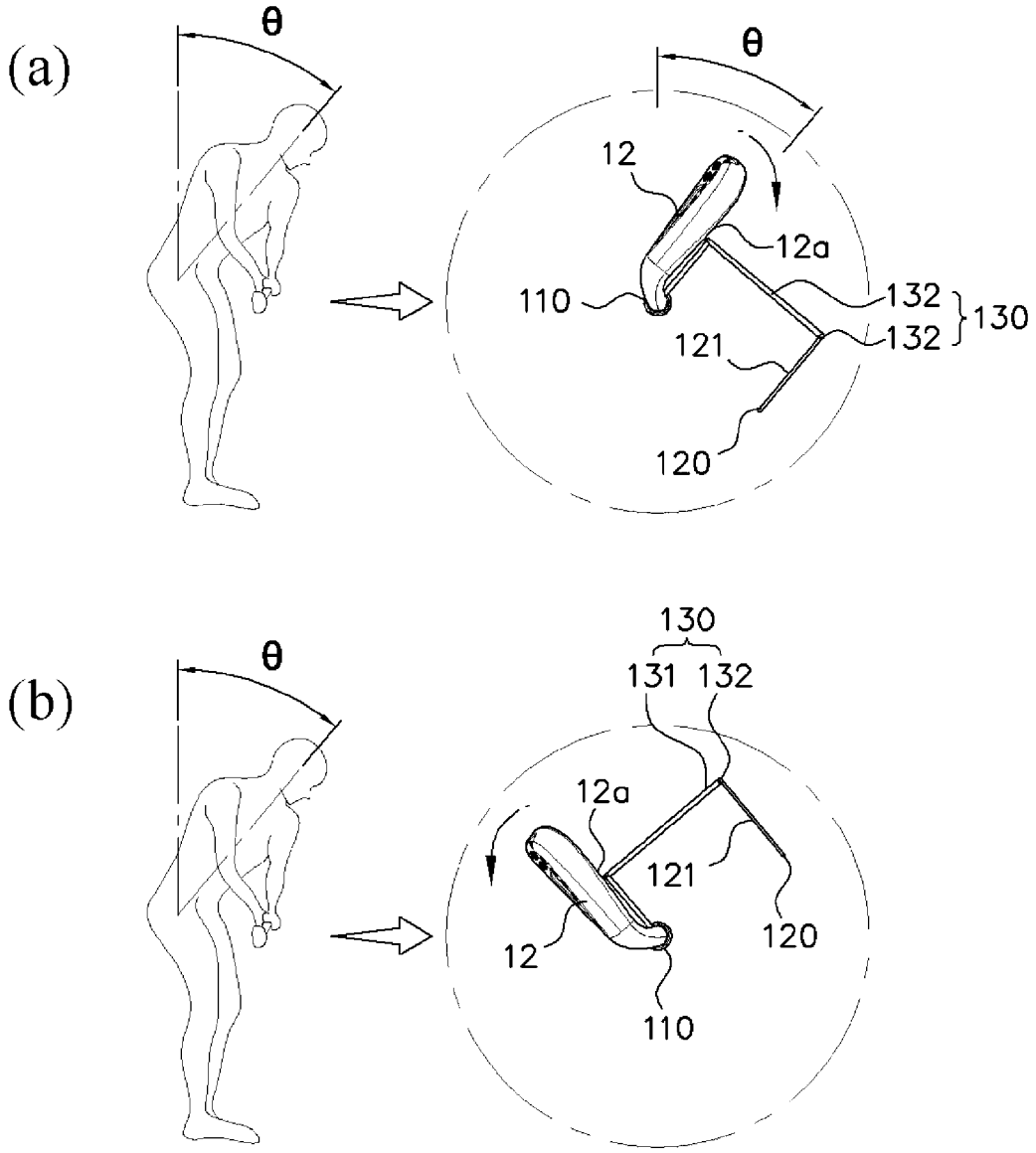
FIG. 12 is a side view showing a state where a golf swing posture is checked in takeaway by using the golf swing guide apparatus according to the second embodiment of the present disclosure.

FIG. 11 is a front view showing a state where a golf swing posture is checked in takeaway by using the golf swing guide apparatus according to the second embodiment of the present disclosure, and FIG. 12 is a side view showing a state where a golf swing posture is checked in takeaway by using the golf swing guide apparatus according to the second embodiment of the present disclosure.

First, (a) of FIG. 11 shows a case where the position and direction of the shaft 11 are correct in takeaway, and (b) of FIG. 11 shows a case where the position and direction of the shaft 11 are incorrect in takeaway.

In addition, (a) of FIG. 12 shows a case where the direction of the club face 12*a* is correct in takeaway, and (b) of FIG. 12 shows a case where the direction of the club face 12*a* is incorrect in takeaway.

As shown in FIGS. 11 and 12, the user can visually confirm the identification mark 121 displayed on one side of the display panel 120 to easily determine whether the position and direction of the shaft 11 is correct in takeaway and whether the direction of the club face 12*a* is correct.

On the other hand, although not shown, the second connecting body 132 may be rotatably coupled to the other end of the first connecting body 131 such that the position and angle of the display panel 120 are adjustable according to the user's body type, the type of the golf club 10, and the like.

Hereinafter, a structure of a golf swing guide apparatus 100 according to a third embodiment of the present disclosure will be described with reference to FIGS. 13 to 15. For convenience of description, a description of the same structure as that of the first embodiment shown in FIGS. 1 to 9 and that of the second embodiment shown in FIGS. 10 to 12 will be omitted, and only differences will be described below.

Figure 13:
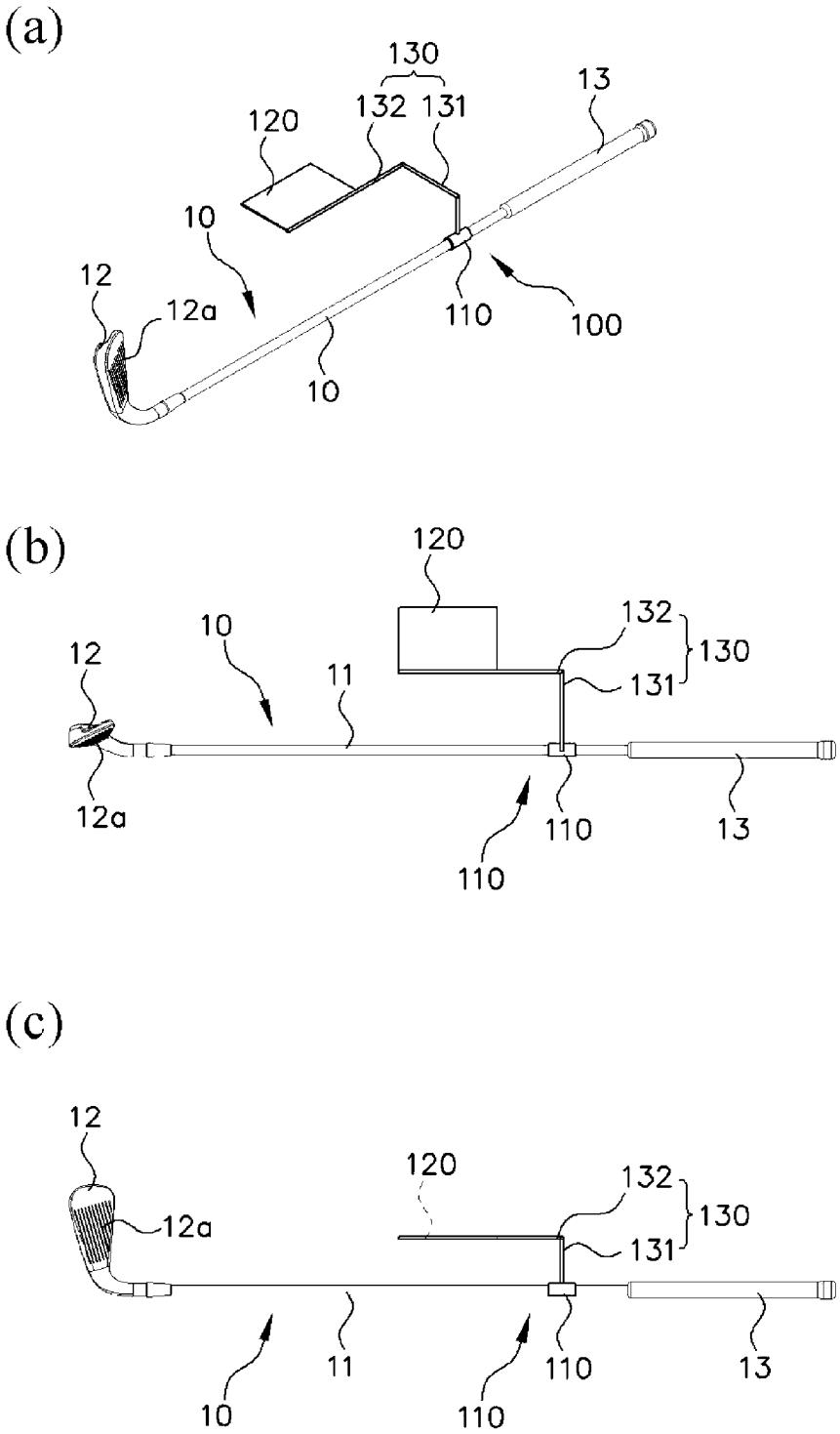
FIG. 13 is a view schematically showing a structure of a golf swing guide apparatus according to a third embodiment of the present disclosure.

FIG. 13 is a view schematically showing the structure of the golf swing guide apparatus according to the third embodiment of the present disclosure.

The golf swing guide apparatus 100 according to the third embodiment of the present disclosure may be used to check whether the position and direction of the golf club 10, that is, the position and direction of the shaft 11 and the direction of the club face 12*a* are correct in address or impact among a plurality of golf swing stages when a user swings the golf club 10.

(a) to (c) of FIG. 13 are a perspective view, a plan view, and a side view of the golf swing guide apparatus 100 according to the third embodiment of the present disclosure, respectively.

As shown in FIG. 13, the golf swing guide apparatus 100 according to the third embodiment of the present disclosure differs from the first embodiment shown in FIGS. 1 to 9 and the second embodiment shown in FIGS. 10 to 12, in that one surface on which the identification mark 121 of the display panel 120 is displayed is disposed perpendicular to the club face 12*a* of the golf club 10.

That is, since the golf swing guide apparatus 100 according to the third embodiment of the present disclosure is used to check whether the position and direction of the golf club 10 are correct in address or impact, it is most important to check the direction of the club face 12*a*. Therefore, one surface on which the identification mark 121 of the display panel 120 is displayed may be disposed perpendicular to the club face 12*a* of the golf club 10.

As shown in FIG. 13, the display panel 120 constituting the golf swing guide apparatus 100 according to the third embodiment of the present disclosure may be disposed perpendicular to the club face 12*a* of the golf club 10 in a state of being spaced apart from the outer circumferential surface of the shaft 11. Preferably, the display panel 120 may be disposed at a position adjacent to the head 12 of the golf club 10 at the front end of the coupling body 110, such that one side on which the identification mark 121 is displayed is located close to the lower portion of the user's face.

In addition, as shown in FIG. 10, one end of the first connecting body 131 constituting the connecting body 130 may be coupled to one side of the coupling body 110, and the other end of the first connecting body 131 may protrude from one side of the coupling body 110 in a first direction perpendicular to the longitudinal direction of the shaft 11, and then, may be bent in a second direction perpendicular to the longitudinal direction and the first direction. That is, the first connecting body 131 may be formed to have an approximately '¬' shape from one side of the coupling body 110.

In addition, the second connecting body 132 may have one end coupled to the other end of the first connecting body 131, and may be spaced apart from the outer circumferential surface of the shaft 11 so as to be parallel to the longitudinal direction of the shaft 11, and the display panel 120 may be coupled to one side thereof.

Hereinafter, an example of checking whether the position and direction of the golf club 10 is correct in address or impact by using the golf swing guide apparatus 100 according to the third embodiment of the present disclosure will be described with reference to FIGS. 14 and 15. For convenience of description, an example of checking whether the position and direction of the golf club 10 are correct in address will be described with reference to FIGS. 14 and 15.

Figure 14:
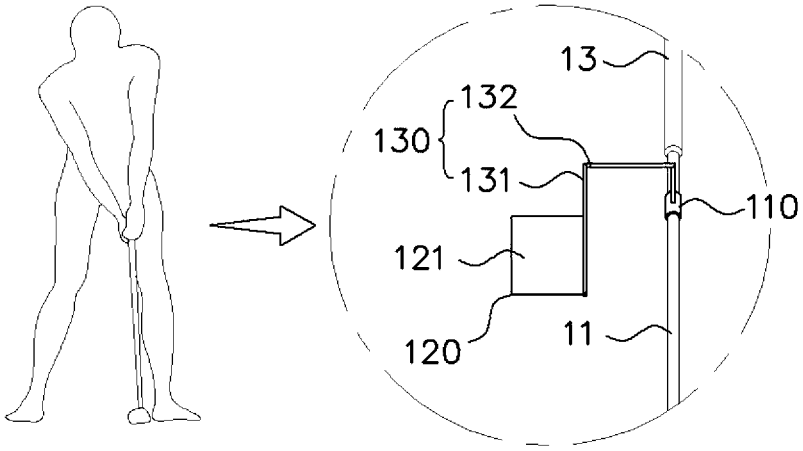
FIG. 14 is a view showing a state where a golf swing posture is checked in address by using the golf swing guide apparatus according to the third embodiment of the present disclosure.
Figure 14:
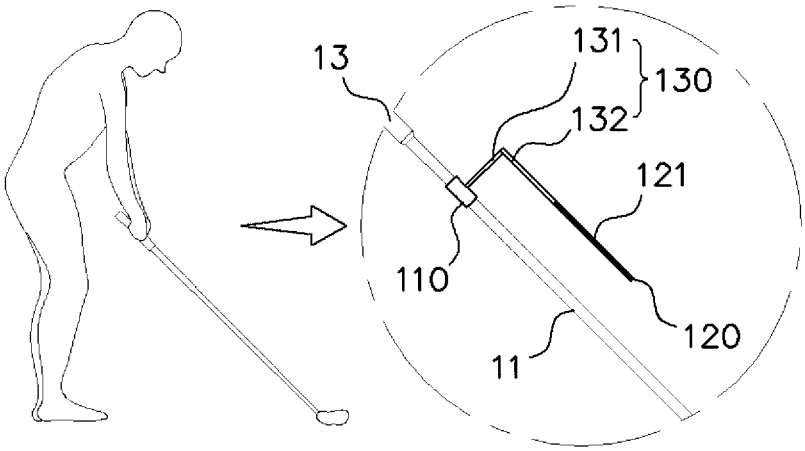
Figure 15:
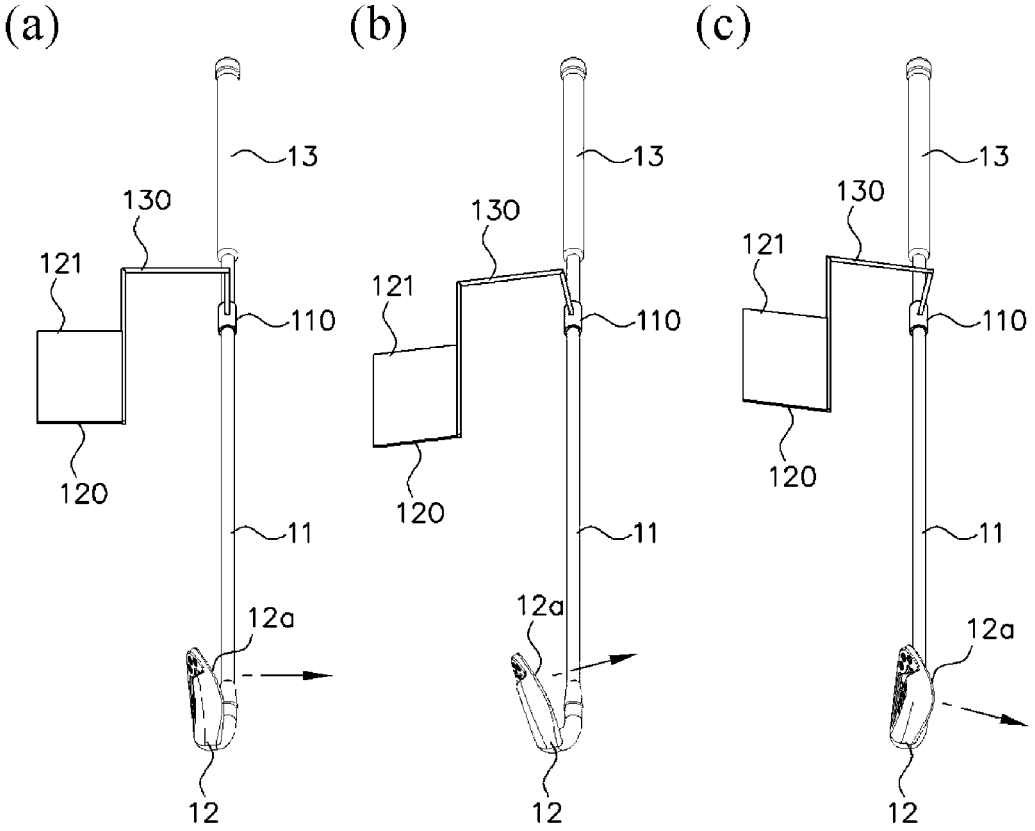
FIG. 15 is a view showing an example in which a user visually confirms a display panel according to a direction of a club face, wherein the display panel constitutes the golf swing guide apparatus according to the third embodiment of the present disclosure in the example shown in FIG. 14.

FIG. 14 is a view showing a state where a golf swing posture is checked in address by using the golf swing guide apparatus according to the third embodiment of the present disclosure, and FIG. 15 is a view showing an example in which a user visually confirms a display panel according to a direction of a club face, wherein the display panel constitutes the golf swing guide apparatus according to the third embodiment of the present disclosure in the example shown in FIG. 14.

(a) of FIG. 14 is a front view showing a case where the position and direction of the shaft 11 are checked in address by using the golf swing guide apparatus 100 according to the third embodiment of the present disclosure, and (b) of FIG. 14 is a side view showing a case where the position and direction of the shaft 11 are checked in address by using the golf swing guide apparatus 100.

In addition, (a) of FIG. 15 shows a case where the direction of the club face 12*a* is correct in address, and (b) and (c) of FIG. 15 show a case where the direction of the club face 12*a* is incorrect in takeaway.

That is, as shown in (a) of FIG. 15, when the direction of the club face (12*a*) is correct in address (that is, when the club face 12*a* is square), the user visually recognizes the display panel 120 as a rectangle, and the identification mark 121 displayed on the display panel 120 may be recognized to have a constant aspect ratio.

On the contrary, as shown in (b) and (c) of FIG. 15, when the direction of the club face 12*a* is incorrect in address (that is, when the club face 12*a* is opened or closed), the user visually recognizes the display panel 120 a distorted rectangle rather than a rectangle, and the identification mark 121 displayed on the display panel 120 may be recognized to have a different aspect ratio.

As shown in FIGS. 11 and 15, the user can visually confirm the identification mark 121 displayed on one side of the display panel 120 to easily determine whether the position and direction of the shaft 11 is correct in address and whether the direction of the club face 12*a* is correct.

On the other hand, although not shown, the second connecting body 132 may be rotatably coupled to the other end of the first connecting body 131 such that the position and angle of the display panel 120 are adjustable according to the user's body type, the type of the golf club 10, and the like.

On the other hand, a case where the golf swing guide apparatus 100 includes one display panel 120 has been described as an example with reference to FIGS. 1 to 15, but the present disclosure is not limited thereto. For example, the golf swing guide apparatus 100 may include a plurality of display panels 120 if necessary.

Figure 16:
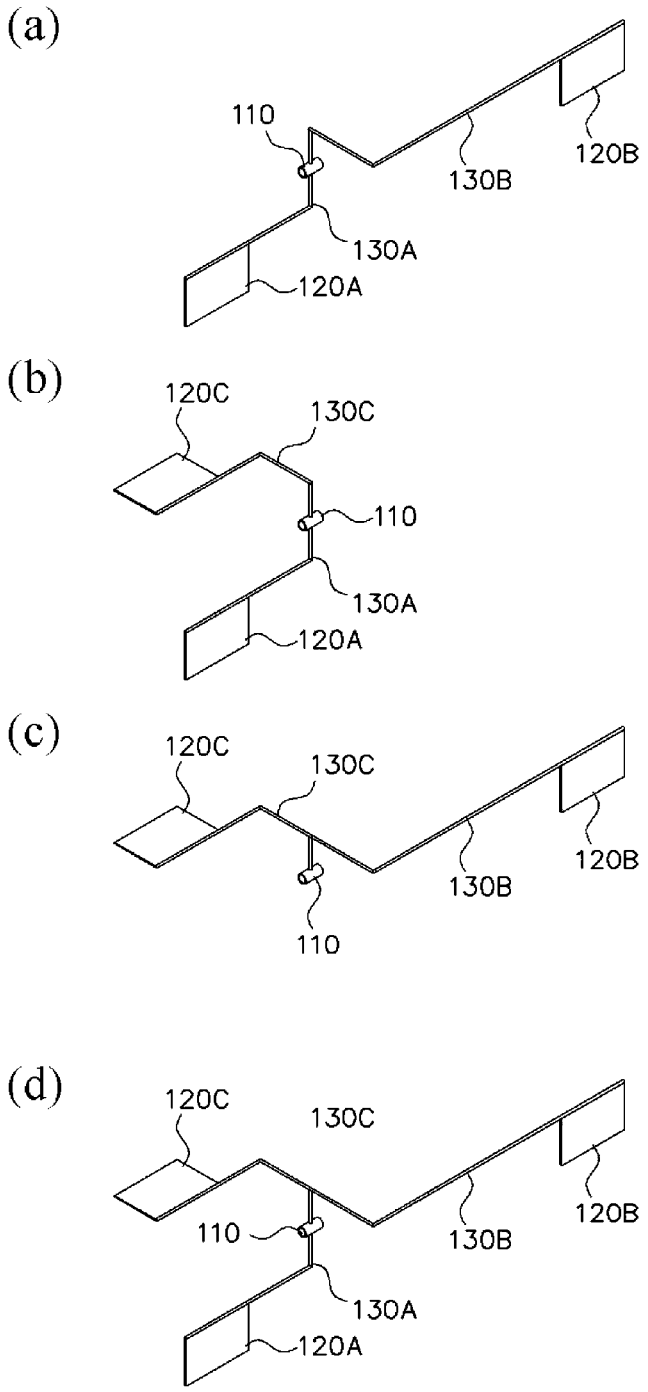
FIG. 16 is a view schematically showing various modifications of the golf swing guide apparatuses according to the embodiments of the present disclosure.

FIG. 16 is a view schematically showing various modifications of the golf swing guide apparatuses 100 according to the embodiments of the present disclosure.

First, (a) of FIG. 16 shows a modification in which the first embodiment shown in FIGS. 1 to 9 and the second embodiment shown in FIGS. 10 to 12 are simultaneously applied. That is, as shown in (a) of FIG. 16, the golf swing guide apparatus 100 is simultaneously provided with two display panels 120 for confirming the position and direction of the golf club 10 in takeaway or follow throw, and the two display panels 120 may have a structure in which one coupling body 110 is coupled by two connecting bodies 130.

In addition, (b) of FIG. 16 shows a modification in which the first embodiment shown in FIGS. 1 to 9 and the third embodiment shown in FIGS. 13 to 15 are simultaneously applied. That is, as shown in (b) of FIG. 16, the golf swing guide apparatus 100 is simultaneously provided with the display panel 120 for confirming the position and direction of the golf club 10 in takeaway or follow throw and the display panel 120 for confirming the position and direction of the golf club 10 in address or impact, and the two display panels 120 may have a structure in which one coupling body 110 is coupled by two connecting bodies 130.

In addition, (c) of FIG. 16 shows a modification in which the second embodiment shown in FIGS. 10 to 12 and the third embodiment shown in FIGS. 13 to 15 are simultaneously applied. That is, as shown in (c) of FIG. 16, the golf swing guide apparatus 100 is simultaneously provided with the display panel 120 for confirming the position and direction of the golf club 10 in takeaway or follow throw and the display panel 120 for confirming the position and direction of the golf club 10 in address and impact, and the two display panels 120 may have a structure in which one coupling body 110 is coupled by two connecting bodies 130.

Finally, (d) of FIG. 16 shows a modification in which the first embodiment shown in FIGS. 1 to 12, the second embodiment shown in FIGS. 10 to 12, and the third embodiment shown in FIGS. 13 to 15 are simultaneously applied.

As described above, in the golf swing guide apparatus 100 according to the embodiments of the present disclosure, the display panel 120 that allows the user to visually check whether the position and direction of the golf club 10 is correct in the golf swing stage when the user swings the golf club 10 is disposed at a position spaced apart from and parallel to the shaft 11 of the golf club 10. Therefore, advanced golfers as well as golf beginners can easily learn and maintain a correct swing posture and correct a swing posture through a simpler structure, without time and space restrictions.

In particular, the golf swing guide apparatus 100 according to the embodiments of the present disclosure allows the user to visually confirm the display panel 120 disposed at a position spaced apart from and parallel to the shaft 11 of the golf club 10. Therefore, the correct swing path can be secured in address, takeaway, impact, and follow-through, which are considered to be the most important in the entire golf swing, through a simpler structure.

In addition, in the golf swing guide apparatus 100 according to embodiments of the present disclosure, one surface on which the identification mark 121 of the display panel 120 spaced apart from the outer circumferential surface of the shaft 11 so as to be parallel to the longitudinal direction of the shaft 11 is displayed is disposed parallel or perpendicular to the club face 12*a* of the golf club 10. Therefore, the user can visually check whether the position and direction of the shaft 11 constituting the golf club 10 are correct in the golf swing stage when the user swings the golf club 10.

On the other hand, in the present specification and the drawings, preferred embodiments of the present disclosure are disclosed. Although certain terms are used, these terms are only used in a general sense to easily explain the technical content of the present disclosure and to help the understanding of the present disclosure, and are not intended to limit the scope of the present disclosure. It will be obvious to those of ordinary skill in the art that other modifications based on the technical idea of the present disclosure may be made thereto.

What is claimed is:

1. A golf swing guide apparatus comprising:

a coupling body configured to detachably attach to a shaft of a golf club that has a club head;

at least one first connecting body;

at least one second connecting body, wherein the at least one first connecting body connects the coupling body and the at least one second connecting body, and the at least one second connecting body is rotatably connected to the at least one first connecting body; and at least one display panel having a first surface and a second surface, the first and second surfaces facing opposite directions, both of the first and second surfaces configured to display an identification mark, and the at least one display panel coupled to the at least one second connecting body wherein the identification mark is either characters or hologram having a predetermined size and shape, and the at least one display panel is positioned in a parallel or perpendicular direction to the club face of the golf club.

2. The golf swing guide apparatus of claim 1, wherein each of the at least one display panel is spaced apart from an outer circumferential surface of the shaft to be parallel to a longitudinal direction of the shaft.

3. The golf swing guide apparatus of claim 1, wherein each of the at least one first connecting body has at least one of a straight line or an L shape.

4. The golf swing guide apparatus of claim 3, wherein the coupling body includes a first coupling body, a second coupling body, and a fastener, and the at least one second connecting body is adjustable in length in a longitudinal direction of the shaft from one end of the at least one first connecting body as the coupling body moves along the shaft.

5. The golf swing guide apparatus of claim 1, wherein the coupling body includes a first coupling body, a second coupling body, and a fastener, and the at least one second connecting body is adjustable in length in a longitudinal direction of the shaft from one end of the at least one first connecting body as the coupling body moves along the shaft.

6. The golf swing guide apparatus of claim 1, wherein the at least first connecting body and the coupling body are integrally formed as a single body.

7. The golf swing guide apparatus of claim 1, wherein the at least one second connecting body and the at least one display panel are integrally formed as a single body.

8. The golf swing guide apparatus of claim 1, wherein the identification mark is the characters with both upward and downward orientations, and the upward orientation of the characters is directed toward the at least second connecting body.

9. The golf swing guide apparatus of claim 1, wherein the at least one first connecting body is normal to the shaft, and the at least one second connecting body is normal to the at least one first connecting body, a part of the at least one first connecting body extends in a first longitudinal direction, and the at least one second connecting body extends in a second longitudinal direction, and the at least one display panel is rotatable about the at least one second connecting body.

10. The golf swing guide apparatus of claim 1, wherein the at least one first connecting body is normal to the shaft, and the at least one second connecting body is normal to the at least one first connecting body, a part of the at least one first connecting body extends in a first longitudinal direction, and the at least one second connecting body extends in a second longitudinal direction, and the at least one display panel is rotatable about the part of the at least one first connecting body extending in the first longitudinal direction.

11. The golf swing guide apparatus of claim 1, wherein the at least one first connecting body is normal to the shaft, and the at least one second connecting body is normal to the at least one first connecting body, a part of the at least one first connecting body extends in a first longitudinal direction, and the at least one second connecting body extends in a second longitudinal direction, and the at least one display panel is rotatable about the part of the at least one first connecting body extending in the first longitudinal direction, and the at least one display panel is rotatable about the at least one second connecting body.

12. The golf swing guide apparatus of claim 1, wherein the at least one first connecting body is normal to the shaft, and the at least one second connecting body is normal to the at least one first connecting body, a part of the at least one first connecting body extends in a first longitudinal direction, and the at least one second connecting body extends in a second longitudinal direction, and the at least one display panel is configured to rotate a full 360 degrees around the part of the at least one first connecting body extending in the first longitudinal direction, the at least one display panel is configured to rotate a full 360 degrees around the at least one second connecting body, and the at least one second connecting body is configured to rotate around an axis extending vertically from a plane formed where the at least one first connecting body and the at least one second connecting body meet.

13. The golf swing guide apparatus of claim 1, wherein the at least one first connecting body has two first connecting bodies, the at least one second connecting body has two second connecting bodies, and the at least one display panel has two display panels, and each of the two first connecting bodies, second connecting bodies, and display panels are coupled, respectively.

14. The golf swing guide apparatus of claim 1, wherein the at least one first connecting body has three first connecting bodies, the at least one second connecting body has three second connecting bodies, and the at least one display panel has three display panels, and each of the three first connecting bodies, second connecting bodies, and display panels are coupled, respectively.

15. A golf swing guide apparatus comprising:

a coupling body configured to detachably attach to a shaft of a golf club that has a club head;

at least one first connecting body having at least one of a straight line or an L shape;

at least one second connecting body, wherein the at least one first connecting body connects the coupling body and the at least one second connecting body, and the at least one second connecting body is rotatably connected to the at least one first connecting body; and at least one display panel having a first surface and a second surface, the first and second surfaces facing opposite directions, both of the first and second surfaces configured to display an identification mark, and the at least one display panel coupled to the at least one second connecting body, spaced apart from an outer circumferential surface of the shaft and disposed in a parallel direction to the club face of the golf club wherein the at least one first connecting body is normal to the shaft, and the at least one second connecting body is normal to the at least one first connecting body.

16. A golf swing guide apparatus comprising:

a coupling body configured to detachably attach to a shaft of a golf club that has a club head;

at least one first connecting body;

at least one second connecting body, wherein the at least one first connecting body connects the coupling body and the at least one second connecting body, and the at least one second connecting body is rotatably connected to the at least one first connecting body; and at least one display panel having a first surface and a second surface, the first and second surfaces facing opposite directions, both of the first and second surfaces configured to display an identification mark, and the at least one display panel coupled to the at least one second connecting body, and spaced apart from an outer circumferential surface of the shaft wherein the identification mark is either characters or hologram having a predetermined size and shape, and the at least one display panel is positioned in a parallel or perpendicular direction to the club face of the golf club, and wherein the at least one first connecting body is normal to the shaft, and the at least one second connecting body is normal to the at least one first connecting body.

17. A golf swing guide apparatus comprising:

a coupling body configured to detachably attach to a shaft of a golf club that has a club head;

at least two first connecting bodies;

at least two second connecting bodies, wherein the at least two first connecting bodies connect the coupling body and the at least two second connecting bodies, respectively, and the at least two second connecting bodies are rotatably connected to the at least two first connecting bodies, respectively; and at least two display panels, each of the at least two display panels having a first surface and a second surface, the first and second surfaces facing opposite directions, both of the first and second surfaces configured to display an identification mark, and the at least two display panel coupled to the at least two second connecting bodies, respectively wherein the identification mark is either characters or hologram having a predetermined size and shape, and each of the at least two display panel is positioned in a parallel or perpendicular direction to the club face of the golf club.

* * * * *